United States Patent [19]

Heil et al.

[11] Patent Number: 5,042,438

[45] Date of Patent: Aug. 27, 1991

[54] VALVE-CONTROLLED INTERNAL COMBUSTION ENGINE

[75] Inventors: Bernhard Heil, Ebersach; Georg Eiermann, Fellbach-Schmiden; Karl Zeilinger, Winnenden, all of Fed. Rep. of Germany

[73] Assignee: Mercedes Benz AG

[21] Appl. No.: 585,824

[22] Filed: Sep. 18, 1990

[30] Foreign Application Priority Data

Sep. 28, 1989 [DE] Fed. Rep. of Germany ..... 3932293

[51] Int. Cl.[5] ..... F01L 1/26; F01L 1/12

[52] U.S. Cl. ..... 123/90.27; 123/432

[58] Field of Search ..... 123/90.22, 90.27, 90.44, 123/308, 432

[56] References Cited

U.S. PATENT DOCUMENTS

| | | | |
|---|---|---|---|
| 4,592,314 | 6/1986 | Tsuchida | 123/90.27 |
| 4,617,881 | 10/1986 | Aoi et al. | 123/90.27 |
| 4,617,896 | 10/1986 | Yoshikawa | 123/432 |
| 4,624,222 | 11/1986 | Yoshikawa | 123/90.27 |
| 4,637,356 | 1/1987 | Kuroda | 123/90.27 |
| 4,638,774 | 1/1987 | Aoi | 123/90.27 |
| 4,660,529 | 4/1987 | Yoshikawa | 123/90.27 |
| 4,766,866 | 8/1988 | Takii et al. | 123/90.27 |
| 4,911,113 | 3/1990 | Yamada | 123/90.27 |
| 4,971,008 | 11/1990 | Morishita | 123/432 |
| 4,979,474 | 12/1990 | Morishita | 123/90.27 |

*Primary Examiner*—Willis R. Wolfe
*Assistant Examiner*—Weilun Lo
*Attorney, Agent, or Firm*—Evenson, Wands, Edwards, Lenahan & McKeown

[57] ABSTRACT

A valve-controlled internal combustion engine has a first valve group consisting of three inlet valves and a second valve group consisting of at least one exhaust valve for each cylinder of the internal combustion engine. The valve axis of one valve of a valve group, relative to valve axis of the other valves of the group, is arranged at a different angle from a center longitudinal plane running through a row of cylindrical bores of the internal combustion engine and is at a different distance from the center longitudinal plane. A camshaft controlling the inlet valves and a second camshaft controlling the exhaust valves or valves are arranged in the cylinder head. Rocker arms for actuating the corresponding cams of the camshafts are rotatably mounted on spindles. The valve axes are at approximately same distance from the longitudinal axis of the camshaft, and the rocker arms for the valves of a valve group are mounted alternately on either side of the camshaft at approximately the same distance from the camshaft.

4 Claims, 2 Drawing Sheets

VALVE-CONTROLLED INTERNAL COMBUSTION ENGINE

BACKGROUND AND SUMMARY OF THE INVENTION

The invention relates to a valve-controlled internal combustion engine.

U.S. Pat. No. 4,617,881 describes an internal combustion engine having a group of three inlet valves and another group of two exhaust valves per cylinder. The valves are arranged around a spark plug provided centrally in the combustion chamber. In order to obtain an optimum arrangement of the valves in the combustion chamber, these valves are fitted at an incline relative to a center longitudinal plane running through the row of cylinder bores. In this known arrangement, the center inlet valve of the three inlet valves has a greater inclination than the two outer inlet valves. As a consequence thereof, the valve-stem end of the center inlet valve in the cylinder head is relatively far away from the center longitudinal plane. Since the center inlet valve is actuated via a bucket tappet, the camshaft controlling the inlet valves must consequently run above the bucket tappet of the center valve. This results in the camshaft axis having to be arranged relatively far to the outside in the cylinder head, as a result of which the width of the cylinder head increases undesirably. Since the outer inlet valves of the valve group are arranged at a less pronounced incline relative to the center valve, their distance from the camshaft in turn inevitably increases and longer rocker arms are required to actuate them. Due to this fact, the mass in the valve-operating gear increases disadvantageously and unavoidable elasticities occur in the valve-operating gear due to longer arms. A further disadvantage is that different cam contours are necessary to obtain an identical valve stroke for all inlet valves of a valve group by the control of the valves on the one hand directly via bucket tappets and on the other hand via rocker arms, as a result of which the manufacture of the camshaft becomes more expensive. In valve-operating gear of this type, the multiplicity of parts increases disadvantageously due to the use of bucket tappets and rocker arms.

An object of the present invention in a valve-controlled internal combustion engine of the type having first and second valve groups is, therefore, to create valve-operating gear which, while retaining a favorable valve arrangement in the combustion chamber, permits a simple arrangement of the components of the valve-operating gear in the cylinder head while requiring few parts. Another object is to provide such valve-operating gear which occupies only a small amount of space in the cylinder head.

Such objects have been achieved according to the present invention by arranging the axes of one valve group at an approximately some distance from a longitudinal axis of the associated camshaft, and mounting rocker arms for the valves of that valve group alternately on either side of the camshaft at approximately the same distance from the latter.

A valve-controlled internal combustion engine has in accordance with the present invention for each cylinder a first valve group consisting of three inlet valves as well as a second valve group consisting of at least one exhaust valve. The valve axis of the valve group is inclined relative to the axes of the other valves of that group so that the end of the valve stem of this group, is at a different distance from an imaginary center longitudinal plane running through the row of cylinder bores of the internal combustion engine. A camshaft for controlling the valves of the first valve group of the cylinders runs with its longitudinal axis above the valve-stem ends at approximately the same distance from the valve axes. Cams arranged on this camshaft, via rocker arms which are in contact at their free end with the valve-stem end, actuate the valve allocated to each of the rocker arms. The rocker arms of the valve group, at their other end, are mounted alternately on either side of the camshaft at approximately the same distance from the camshaft.

By virtue of this arrangement, the width of the cylinder head can be reduced, and, to reduce the multiplicity of parts, all valves of the group are actuated via rocker arms of the same type. The length of the rocker arms is limited and a reduction in the masses as well as in the elasticities is thereby achieved. In addition, the roof shaped design of the combustion chamber and thus a favorable combustion-chamber form can be retained.

BRIEF DESCRIPTION OF THE DRAWINGS

These and other objects, features and advantages of the present invention will become more readily apparent from the following detailed description of a presently preferred embodiment when taken in conjunction with the accompanying drawing wherein.

DETAILED DESCRIPTION OF THE DRAWINGS

Figure 1:
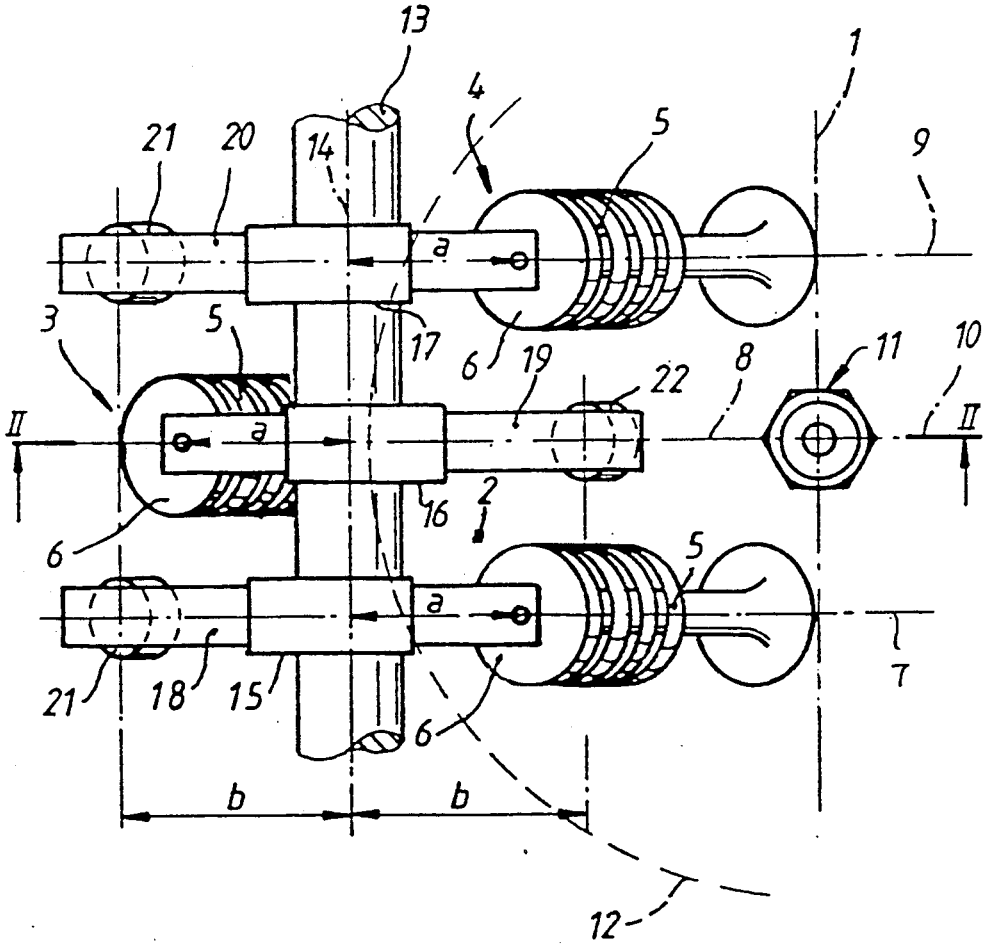
FIG. 1 is a plan view of valve-operating gear arrangement according to the present invention with regard to the inlet valves of a cylinder.

For greater clarity, conventional components, such as, for example, the cylinder head, are not depicted in FIG. 1. In addition, the exhaust side of the engine is also not depicted, since this can be designed in any manner. Thus, it is conceivable to provide only one exhaust valve or a plurality of exhaust valves per cylinder. Also, a valve arrangement on the exhaust side corresponding to the arrangement of the inlet side is particularly favorable.

A group of three inlet valves 2, 3, and 4, is arranged on one side of the center longitudinal plane 1 running through the row of cylinder bores of the internal combustion engine, and valve springs 5 as well as their supporting plates 6 can also be seen in FIG. 1. The valves 2, 3 and 4 have corresponding axes 7, 8 and 9, respectively. A spark plug 11 is provided at the intersection of the center longitudinal plane 1 and of a plane 10 running through the valve axis 8 of the center valve 3 of the group perpendicularly to the center longitudinal plane 1. The spark plug 11 therefore lies in the center of the combustion chamber 12, indicated by a dashed arcuate line, and thus in a optimized position.

The spark plug 11 is surrounded in a circular manner by the valve discs (not shown) in the plane of the combustion chamber 12. This results in an arrangement of valves and spark plugs in the combustion chamber which is favorable for the operation of the internal combustion engine. In order to obtain this arrangement, the axes 7, 8 and 9 of the valves 2, 3 and 4 must be inclined relative to the center longitudinal plane 1, and more particularly the axis 8 of the center valve 3 of the valve group must be inclined to a greater extent than the axes 7 and 9 of the two outer valves 2 and 4.

In order to make possible uniform actuation of the valves 2, 3, and 4 in a compact cylinder head construction, the camshaft 13 is arranged between the valves 2, 3 and 4 in such a way that the valve axes 7, 8 and 9 are at approximately the same distance a from the longitudinal axis 14 of the camshaft 13. In this embodiment, the valve is controlled by the cams 15, 16 and 17, which are provided on the camshaft 13 and actuate the associated valves 2, 3 and 4 via respective rocker arms 18, 19 and 20. These rocker arms 18, 20 and 19 of the valve group 2, 3, 4 are arranged alternately on either side of the camshaft 13 at approximately the same distance b from the latter and are mounted, for example, on hydraulic elements 21 and 22, respectively, provided in the cylinder head 29.

Figure 2:
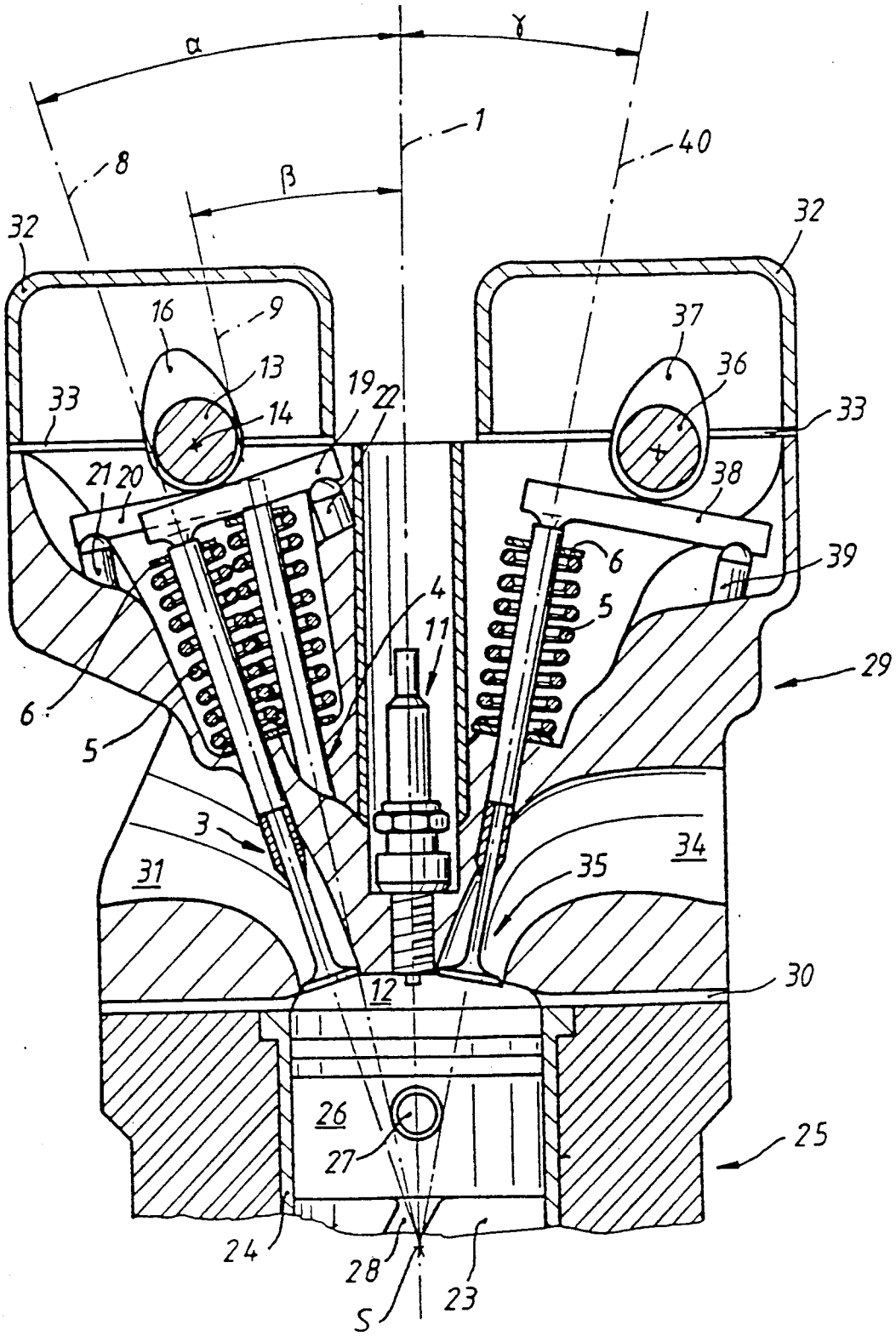
FIG. 2 is a cross-sectional elevation view through the valve-operating gear along section line II—II in FIG. 1.

FIG. 2 shows a cross-sectional view through the valve-operating gear according to the invention along section line II—II in FIG. 1 (but also showing the exhaust side of the cylinder head), the same parts being given the reference numerals used in FIG. 1. A cylinder 23 with a cylinder liner 24 is operatively arranged in an engine block 25. The cylinder 23 accommodates a piston 26 which, via a connecting rod 28 linked to the gudgeon pin 27, is connected to a crankshaft (not shown) of the internal combustion engine. A cylinder head 29 which is separated from the engine block 25 by a cylinder-head gasket 30 is put onto the engine block 25 in a conventional manner. The attachment of the cylinder head 29 to the engine block 25 is generally known and therefore need not be shown and described here in greater detail. For accommodating coolants, both the engine block 25 and the cylinder head 29 are normally provided with hollow spaces and channels (not shown for better clarity).

Inlet ports which can be closed by inlet valves lead into the combustion chamber 12 of the cylinder 23. Of the inlet ports, only the inlet port 31 plus the inlet valve 3 associated therewith are seen in FIG. 2. The stem of the valve 3 is axially movably guided in the cylinder head 29. The valve 3 is held in its closed position by the valve spring 5 which is supported on the cylinder head 29 on its one end and on the supporting plate 6 fixed to the valve 3 on its other end. The valve axis 8 of the valve 3 is inclined at an angle $\alpha$ relative to the center longitudinal plane 1 and intersects the plane 1 at a straight line S extending in the longitudinal direction of the internal combustion engine.

A second inlet valve 4 of the inlet-valve group, is identical in function to inlet valve 3. The valve axis 9 of the valve 4 forms an angle $\beta$ with the center longitudinal plane 1, which angle $\beta$ is less than the angle o between valve axis 8 and the center longitudinal plane 1. The valve axis 9 likewise intersects the center longitudinal plane 1 at the straight line S shown as a point in FIG. 2. An optimized combustion-chamber design is therefore obtained together with the spark plug 11 arranged centrally in the combustion chamber 12. If the valve axes are inclined not only relative to the center longitudinal plane 1, but in addition also in the longitudinal direction of the internal combustion engine, the straight line S merges into a point at which all valve axes as well as the longitudinal axis of the spark plug 11 intersect, so that a geometry adapted to a spherical shape of the combustion chamber 12 can be realized.

The inlet valves, of which only the two valves 3 and 4 are shown, are actuated via corresponding rocker arms 19 and 20, respectively, by the camshaft 13 provided with corresponding cams (e.g., cam 16 for the rocker arm 19 of the valve 3). The rocker arms of a valve group 2 (not shown in FIG. 2), 3 and 4 are mounted alternately on either side of the camshaft 13 in hydraulic elements 21 and 22, respectively, which compensate play. The distance of these hydraulic elements 21 and 22 from the longitudinal axis 14 of the camshaft 13, from which the valve axes 7, 8 and 9 are, to the extent possible, in turn at the same distance, is here advantageously the same. With this construction, it is possible for a plurality of components, such as rocker arms and valves, to be given an identical configuration, and it may also be possible to use the same cam contour for all inlet valves. The cylinder head 29, despite the diverging valve axes, only requires a narrow width on account of the favorable arrangement of the valve-operating gear. The cylinder head is closed off at the top via a cylinder-head lid 32 which is sealed off from the cylinder head by a gasket 33. The attachment of this lid part does not form part of the present invention and is therefore not shown.

The exhaust side of the cylinder head 29 is provided with an exhaust port 34 which is closed by a valve 35. The stem of this valve 35, as with the inlet valves described above, carries the supporting plate 6, on which the valve spring 5 is supported, and is thus held in the closed position. The valve axis 40 is inclined relative to the center longitudinal plane 1 by the angle $\delta$ and intersects this center longitudinal plane 1 at the intersection line or, as seen in FIG. 2, at the intersection point S. The valve 35, via a rocker arm 38 which is mounted on a hydraulic element 39, is actuated by a camshaft 36 which is provided with cams 37. The exhaust side shown can have both one exhaust valve per cylinder or else a group of exhaust valves. This group of exhaust valves can be advantageously arranged and constructed analogously to the group of inlet valves described above, i.e. three exhaust valves per group. In this case, the angle (here: $\delta$) formed between center longitudinal plane 1 and the corresponding valve axis (here: 40) corresponds to the corresponding angle $\alpha$ or $\beta$ on the inlet side. The space formed in this part of the cylinder head 29 is also closed off at the top by the cylinder-head lid part 32 plus the gasket 33. The inlet side and the exhaust side, with the exception of the different cam contours between inlet and exhaust, are then symmetric.

The use of the rocker-arm control, in contrast with bucket tappets even when the valve axes vary, permits a valve control with one camshaft per valve group, i.e. a camshaft controlling the inlet and a camshaft controlling the exhaust, without restrictions in the progress of the valve stroke while at the same time occupying a small amount of space.

Although the valve-operating gear, in the illustrated embodiment of the present invention described here, has only been shown for one cylinder of an internal combustion engine, it is to be clearly understood that the present invention is not restricted to specific illustrated details but that the invention can also be used in multicylinder internal combustion engines of every known type of construction, such as, for example, in-line engines, V-engines, etc.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A valve-controlled internal combustion engine, comprising a first valve group having three inlet valves, a second valve group having at least one exhaust valve for each cylinder of the internal combustion engine, a valve axis of one valve of a valve group, relative to valve axis of the other valves of the group, being arranged at a different angle from a center longitudinal plane running through a row of cylinder bores of the internal combustion engine and at a different distance from the center longitudinal plane, a camshaft controlling the inlet valves, a second camshaft controlling the at least one exhaust valves, rocker arms rotatably mounted on spindles, for actuating associated ones of the valves via corresponding cams of the camshafts, wherein the valve axis of one valve group are at an approximately same distance from a longitudinal axis of the associated camshaft, and the rocker arms for the valves or one valve group are mounted alternately on each side of the camshaft at approximately the same distance from the camshaft.

2. The valve-controlled internal combustion engine according to claim 1, wherein the valve axes of the one valve group are at the same distance from the longitudinal axis of the associated camshaft, and the rocker arms for the valves of the one valve group are mounted alternately on either side of the camshaft at the same distance from the latter.

3. The valve-controlled internal combustion engine according to claim 1, wherein the rocker arm of the center valve of a valve group and the rocker arms of the outer valves of that valve group are each mounted on a separate shaft.

4. The valve-controlled internal combustion engine according to claim 3, wherein the valve axes of the one valve group are at the same distance from the longitudinal axis of the associated camshaft, and the rocker arms for the valves of the one valve group are mounted alternately on either side of the camshaft at the same distance from the latter.

* * * * *